US007093403B2

(12) United States Patent
Huntting et al.

(10) Patent No.: US 7,093,403 B2
(45) Date of Patent: Aug. 22, 2006

(54) FRAME FOR MOUNTING TO A PREMOUNTED MIRROR

(75) Inventors: Lisa Huntting, Charlotte, NC (US); Mark Lacko, Garrison, NY (US)

(73) Assignee: Mirrormate, LLC, Charlotte, NC (US)

( * ) Notice: Subject to any disclaimer, the term of this patent is extended or adjusted under 35 U.S.C. 154(b) by 164 days.

(21) Appl. No.: 10/663,963

(22) Filed: Sep. 16, 2003

(65) Prior Publication Data

US 2005/0055907 A1 Mar. 17, 2005

(51) Int. Cl.
*A47G 1/00* (2006.01)

(52) U.S. Cl. ..... 52/785.1; 40/768; 40/798

(58) Field of Classification Search ..... 52/785.1, 52/797.1, 800.11, 800.12; 40/729, 727, 900, 40/768, 732, 798

See application file for complete search history.

(56) References Cited

U.S. PATENT DOCUMENTS 4,275,972 A * 6/1981 Bowen et al. ..... 403/401
5,950,342 A * 9/1999 Suesholtz ..... 40/768
6,612,060 B1 * 9/2003 Pearce ..... 40/739

OTHER PUBLICATIONS

4 Photographs of The Rear of A Prior Art Picture Frame.
F-4000 Cornerlock™ Joiner, The Fletcher-Terry Company, http://www.fletcher-terry.com/fletcherterry/ecatalog/viewfamily.jsp?level=4&parent_id=128&parent_id . . . , dated May 6, 2003, 4 pages.

* cited by examiner

*Primary Examiner*—Naoko Slack
(74) *Attorney, Agent, or Firm*—Adams Evans P.A.

(57) ABSTRACT

A frame is mounted to a front surface of a previously mounted mirror so that recesses in the back side of the frame receive protruding portions of fasteners which attach the frame to a supporting structure. Guide structures are temporarily mounted to the front surface of the mirror to facilitate the mounting of the frame to the mirror. The guide structures are used to suspend the frame in a position forward of the mirror. Then, while the frame is suspended by the guide structures, the frame is pushed toward the mirror so that the frame slides along the guide structures. As a result, adhesive strips, which are mounted to the back of the frame, engage the front surface of the mirror and become adhered thereto, so that the frame is mounted to the front surface of the mirror by the adhesive strips.

19 Claims, 11 Drawing Sheets

FRAME FOR MOUNTING TO A PREMOUNTED MIRROR

BACKGROUND OF THE INVENTION

The present invention pertains to frames and, more particularly, to framing a premounted mirror.

It is prior art to frame a premounted mirror without unmounting the mirror, such as by cutting pieces from chair rail molding or ceiling molding, mitering the ends of the pieces, and then gluing the pieces to the margin of the mirror one at a time/piece by piece, and respectively end to end. The pieces are finished by painting or staining them.

This prior art technique has not been widely adopted because it has numerous shortcomings. Accordingly, there is a need in the art for improvements relating to the framing of premounted mirrors.

BRIEF SUMMARY OF SOME ASPECTS OF THE INVENTION

One aspect of the present invention is the provision of a frame that is for being mounted to (e.g., being adhered to) the front surface of a previously mounted mirror. Preferably the mirror has been previously mounted to a supporting structure by fasteners located at the margin of the mirror. In accordance with this aspect, recesses extend into the frame from its rear surface, and the recesses are for receiving protruding portions of the fasteners, so that at least a substantial portion of the rear surface of the frame is substantially flush with the front surface of the mirror. As a result, the frame advantageously functions as a decorative accent that at least substantially hides the margin of the mirror and the fasteners, and the frame surmounts the physical barrier posed by the protruding portions of the fasteners.

In accordance with one aspect of the present invention, the frame is advantageously distinguished from prior frames that have rabbets at their innermost periphery. That is, the frame of the present invention preferably does not have a rabbet at its innermost periphery. As a result, and advantageously, preferably neither the recesses nor the fasteners will be seen via a reflection in the mirror while the frame is mounted to the mirror.

In accordance with one aspect of the present invention, guide structure(s) are temporarily mounted to the front surface of the mirror to at least partially facilitate the mounting of the frame to the mirror. For example, prior to mounting the frame to the mirror, and preferably prior to removing any protective backing from adhesive strips attached to the rear surface of the frame, the frame is held up to the mirror in a predetermined position. The predetermined position is characterized by the protruding portions of the fasteners being respectively received by the recesses, and the frame otherwise being oriented as desired. While the frame is in the predetermined position with the protective backing of the frame's adhesive strips engaged to the front surface of the mirror, the guide structures are mounted at predetermined locations so that they can be used in the process of returning the frame to the predetermined position for mounting.

After the guide structures are mounted at their predetermined locations, the frame is removed from the mirror and the guide structures. Then, the protective backing is removed from the adhesive strips attached to the rear surface of the frame. The frame is mounted by first using the guide structures to position the frame in front of the predetermined position, such that the guide structures are suspending the frame in front of the mirror. Then, while the frame is suspended by the guide structures, the frame is pushed toward the mirror so that the frame slides along the guide structures. As a result, the adhesive strips eventually engage the front surface of the mirror and become adhered thereto, so that the frame is mounted to the front surface of the mirror. The guide structures advantageously assist in efficiently obtaining an optimal mounting of the frame to the mirror. The guide structures are removed from the mirror after the frame is mounted.

In accordance with one aspect of the present invention, the frame does not interact with fasteners that are for fastening the mirror to a wall, or the like. This may be the case, for example, when the rear surface of the mirror is adhered to the wall with epoxy.

BRIEF DESCRIPTION OF THE DRAWINGS

Having described some aspects of the invention in general terms, reference will now be made to the accompanying drawings, which are not necessarily drawn to scale, and wherein:

FIG. 2 is a partially schematic, front elevational view of a frame mounted to the front surface of the mirror of FIG. 1, in accordance with an exemplary embodiment of the present invention;

FIG. 10 is a schematic front view illustrating the frame exploded away from the mirror, with the alternative guide structures attached to the frame, in accordance with an alternative embodiment of the present invention.

DETAILED DESCRIPTION OF THE INVENTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

Figure 1:
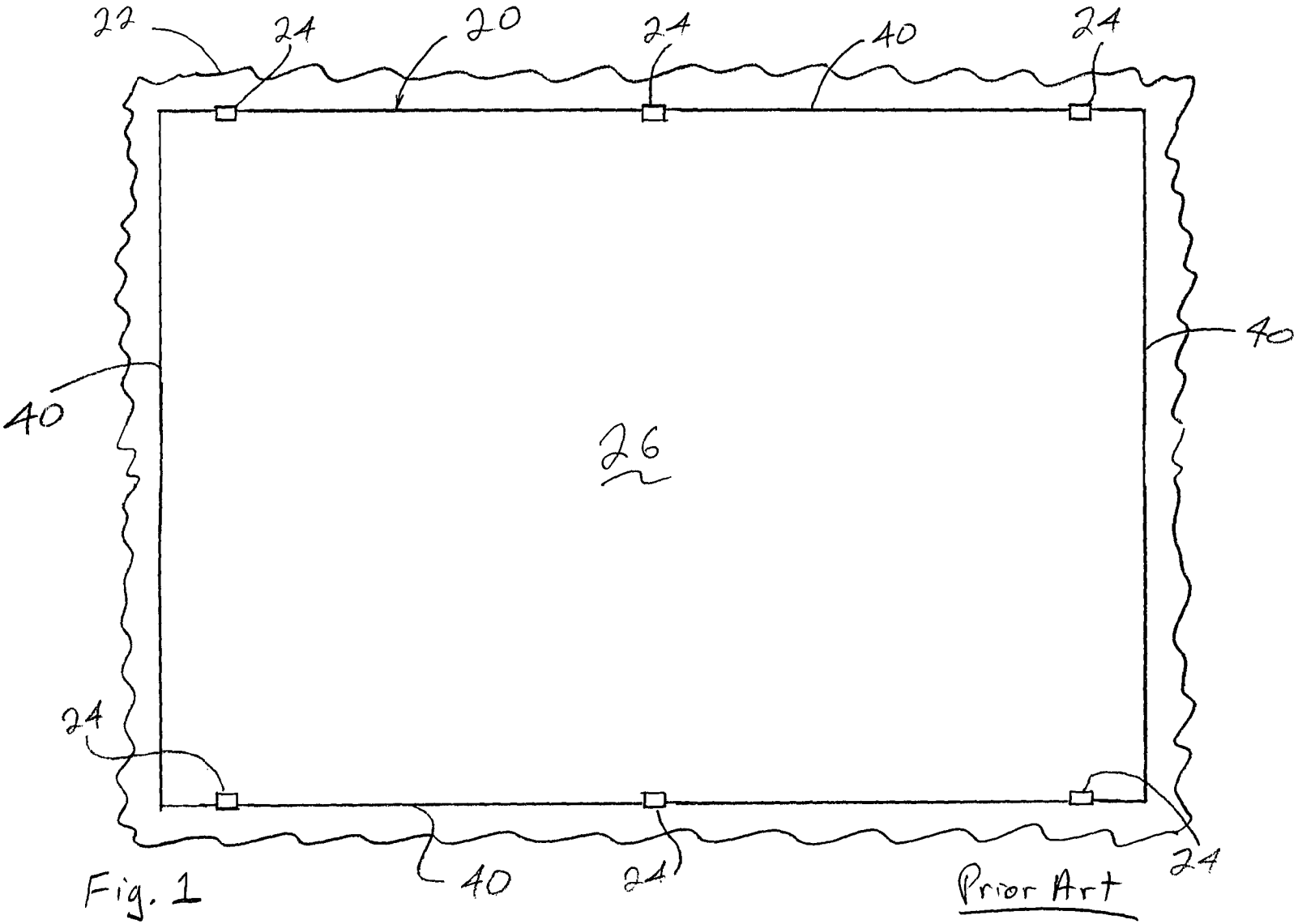
FIG. 1 is a partially schematic, front elevational view of a mirror fastened to a portion of a wall, in accordance with the prior art.

FIG. 1 is a partially schematic, front elevational view of a mirror 20 fastened to a portion of a wall 22 of a building, or the like, by fasteners 24. The fasteners 24 extend around the edge of the mirror 20 and engage marginal portions of the broad front surface 26 of the mirror. The mirror 20 includes a broad rear surface which is opposite from the front surface 26 and is in opposing face-to-face relation with the wall 22.

FIG. 2 is a partially schematic, front elevational view of a frame 28 mounted to the margin of the front surface 26 of the mirror 20, in accordance with an exemplary embodiment of the present invention. The frame 28 defines a central opening 30 through which the front surface 26 of the mirror 20 can be viewed. The frame 28 preferably covers the entire margin of the mirror 20 as well as the fasteners 24 (FIG. 1), such that they are at least substantially hidden from view. As illustrated in FIG. 2, the frame 28 includes four sidepieces 32 that are respectively joined to one another end to end, at miter joints 34, as will be discussed in greater detail below.

Figure 3:
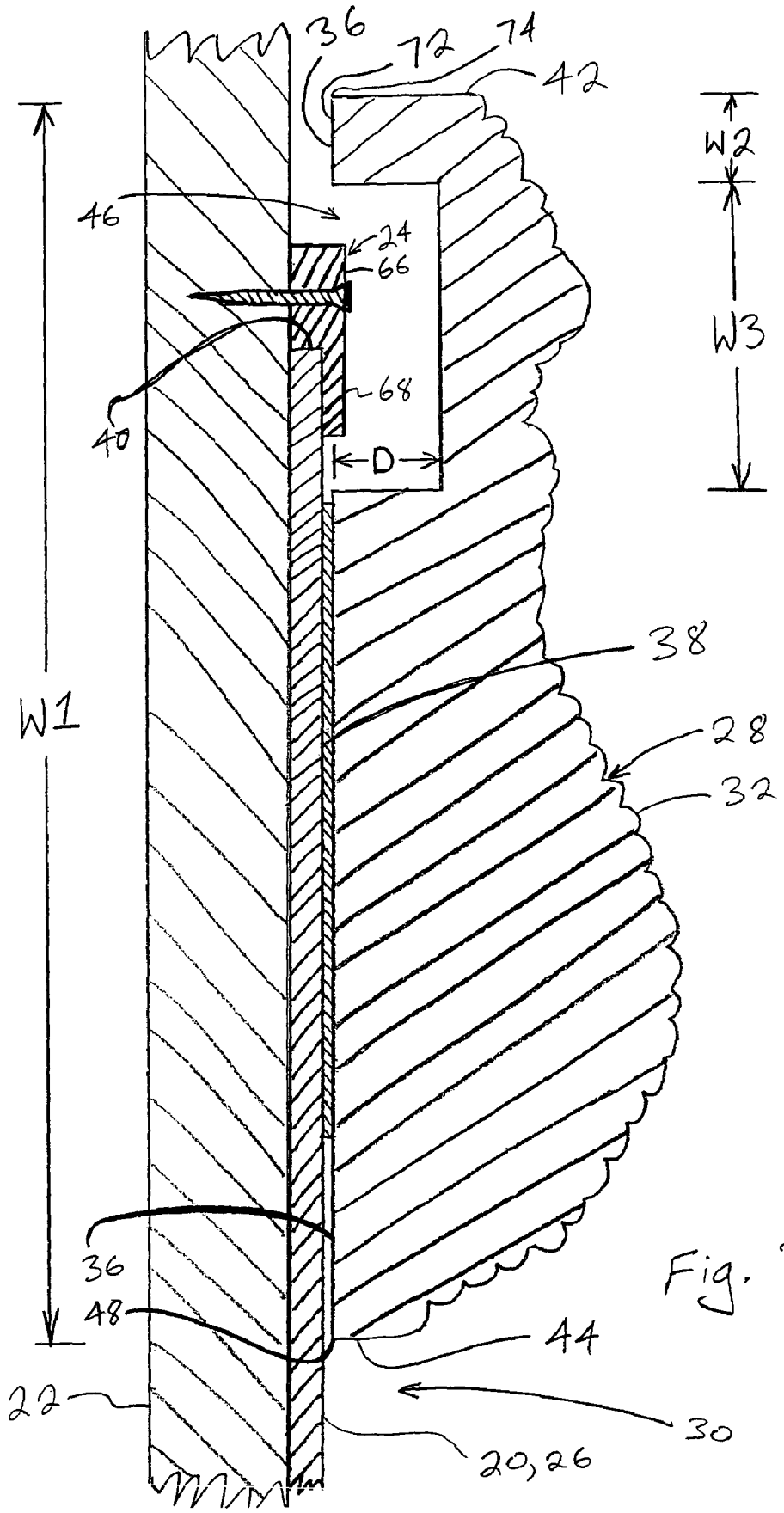
FIG. 3 is a partially schematic, cross-sectional, partial view that is at least partially illustrative of cross-sections taken along each of lines 3—3 of FIG. 2.

FIG. 3 is illustrative of cross-sections taken along each of the lines 3—3 of FIG. 2, except that the cross-sections through the upright sidepieces 32 would not include the fasteners 24 since they are not present at the mirror's upright edges 40 in FIG. 1. The rear surface 36 of the frame 28 is adhered to the margin of the front surface 26 of the mirror 30 by fastening strips 38. The fastening strips 38 can be pressure-sensitive, double-sided tape (preferably a type that provides a permanent attachment), Velcro brand hook and loop fasteners, or the like. The fastening strips 38 can be replaced by other fastening devices which provide the desired function.

As best understood with reference to FIGS. 1–3, each of the mirror 20 and the frame 28 define an overall height and width, and in accordance with the exemplary embodiment of the present invention, the overall height and width of the frame are respectively at least as large as the overall height and width of the mirror. In accordance with one example, the overall height and width of the frame 28 are respectively greater than the overall height and width of the mirror 20, such as by about ½ inch or a little more. In accordance with the exemplary embodiment, the outermost edge 40 (FIGS. 1 and 3) of the mirror is closer to the outermost periphery 42 (FIGS. 2 and 3) of the frame 28 than to the innermost periphery 44 (FIGS. 2 and 3) of the frame. Alternatively, and depending on how much open space is available around the periphery of the mirror 20, the outermost edge 40 of the mirror can be closer to the innermost periphery 44 of the frame 28 than to the outermost periphery 42 of the frame.

Figure 4:
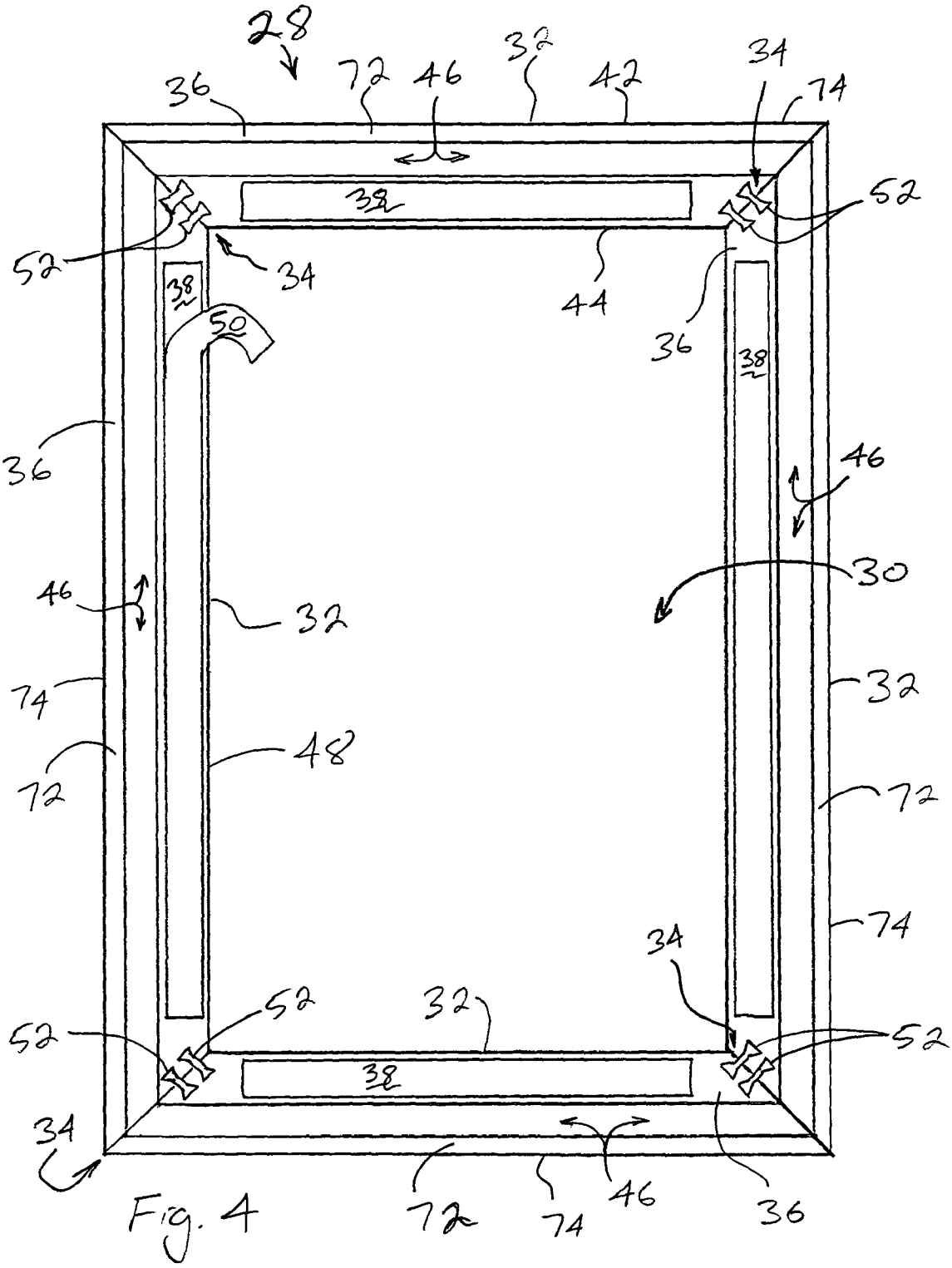
FIG. 4 is an isolated, partially schematic, rear elevational view of the frame of FIG. 2.

As best understood with reference to FIG. 3, each of the fasteners 24 can include a protruding portion extending forward of the front surface 26 of the mirror 20. The rear of the frame 28 defines recesses 46 (also see FIG. 4) that respectively receive the protruding portions of the fasteners 24, so that at least a substantial portion the rear surface 36 of the frame is substantially flush with the front surface 26 of the mirror 20. That is, and advantageously, the recesses 46 respectively receive the protruding portions of the fasteners 24 so that they do not have a negative impact on adhering the frame 28 to the mirror 20. As illustrated in FIGS. 3 and 4, the recesses 46 are preferably between and distant from the outermost and innermost peripheries 42, 44 of the frame 28, so as to optimally hide the fasteners 24.

The frame 28 of the exemplary embodiment is preferably distinguished from one type of prior framed mirror because, for example, the frame 28 preferably does not include a rabbet that is in receipt of the outer peripheral edge 40 of the mirror 20. More specifically, the rear surface 36 of the frame 28 and the innermost periphery 44 of the frame intersect at an inner circumferential edge 48 of the frame, and the inner circumferential edge 48 and the rear surface 36 of the frame are substantially within a common plane. In addition, it is preferred for the recesses 46 to be distant from the inner circumferential edge 48. As a result, the rear surface 36 of the frame 28 has an inner marginal portion that is adjacent the inner circumferential edge 48, and the recesses 46 will not be seen via a reflection in the mirror 20 while the frame 28 is mounted to the mirror.

In accordance with the exemplary embodiment of the present invention, the inner marginal portion of the rear surface 36 of the frame 28 is painted black or covered with fastening strips 38 that are black, or the like. This mutes any reflection of the rear surface 36 of the frame 28, or associated structures, that is seen via a reflection in the mirror 20 while the frame is mounted to the mirror. Alternatively, the entire rear surface 36 of the frame 28 can be painted black, or the like. In accordance with one example, it is preferred for the inner marginal portion of the rear surface 36 of the frame 28 not to be covered by the fastening strips 38 and to be sufficiently wide so that the fastening strips are not seen when viewing the front surface 26 of the mirror 20 while the frame 28 is mounted to the mirror.

As illustrated with respect to a representative one of the fastening strips 38 in FIG. 4, the fastening strips are preferably originally covered with a readily removable protective backing 50. Only one protective backing 50 is shown in FIG. 4, and it is partially peeled back to expose the fastening strip 38 that it covers. The protective backing 50 is removed from each of the fastening strips prior to the final step of mounting the frame 28 to the mirror 20, as will be discussed in greater detail below. In accordance with an alternative embodiment of the present invention, glue or another type of adhesive, or other fastening means, can be used in place of the fastening strips 38.

As best understood with reference to FIG. 4, each miter joint 34 includes one or more fastening mechanisms for maintaining the joint in a secure fashion. In accordance with the exemplary embodiment, each miter joint 34 is secured by a pair of fasteners which are generally in the form of I-shaped connectors 52 that are respectively received in correspondingly shaped holes routed into the ends of each of the sidepieces 32. The connectors 52 are preferably pushed in sufficiently far so that they are flush with the rear surface 36 of the frame 28. The holes that receive the connectors 52 are preferably tapered in a manner such that the ends of the sidepieces 32 are respectively drawn together when the connectors are inserted in their respective holes. As a result, the miter joints 34 are tight and visually pleasing. The ends of the sidepieces can additionally be glued together to form the miter joints 34, or be joined by any other suitable methods or devices.

The holes for receiving the connectors 52 can acceptably be formed using a Corner Lock 4000 brand joiner available from the Fletcher-Terry Company of Farmington, Conn. Acceptable connectors 52 (e.g., wedges) are also available from the Fletcher-Terry Company. As an alternative, other routers and fasteners (e.g., connectors, wedges, or the like) can be used.

The sidepieces 32 of the frame 28 can be constructed of any type of material used for the sidepieces of conventional picture frames, such as wood, medium density fiberboard, or the like. The front surfaces of the sidepieces 32 can be shaped/formed in the same manners in which front surfaces of the sidepieces of conventional frames are formed. As illustrated in FIG. 3, the front surface of the frame 28 can be decorative, and other decorative front surfaces are within the scope of the present invention. The recesses 46, each of which is preferably uniform along its length, can be formed in the sidepieces 32 using a router or a molding machine, or the like.

Typically the sidepieces 32 will be cut from a stock piece after the recess 46 and any ornamentation have been formed in the stock piece. Each such stock piece in isolation and each of the sidepieces 32 in isolation is an article of manufacture that is believed to be inventive. In accordance with exemplary embodiments of the invention, each of the stock pieces is substantially uniform along its length, and cross-sections perpendicular to the lengths of the stock pieces correspond to cross-sections perpendicular to the lengths of the sidepieces (e.g., sidepieces 32) of the frames of the present invention.

A method of obtaining and assembling a frame 28 will now be described, in accordance with the exemplary embodiment of the present invention. A customer who desires to mount a frame 28 to a mirror 20 will select a type or style of frame to match the style of the bathroom, bar, or wherever their mirror is installed. The customer will then collect pertinent information that will be conveyed to the supplier of the frame 28. The pertinent information will typically include a measurement of the height and width of the mirror 20. The pertinent information may also include an indication as to whether/where the mirror 20 abuts or is in close proximity to a wall, ceiling or backsplash, or the like. The pertinent information can also include an indication of how the mirror 20 is affixed to the wall 22, as will be discussed in greater detail below. Then, the customer orders the frame 28 from the supplier, with the order including the pertinent information. Based upon the pertinent information, the supplier of the frame 28 selects and ships the appropriate frame and/or frame components to the customer.

Although the frame 28 could be fully assembled when shipped by the supplier to the customer, it is preferred for the frame to be shipped in a disassembled state. The customer assembles the frame 28 by arranging the sidepieces 32 end to end as illustrated in FIG. 4. Then, the connectors 52 are respectively inserted into their holes/receptacles in the sidepieces 32 to form the miter joints 34 and thereby form the frame 28. The miter joints 34 can additionally be glued, or joined by any other suitable method or device to form the frame 28. In accordance with some embodiments of the present invention, the ends of the sidepieces 32 are joined at joints other than miter joints to form the frame 28.

The frame 28 is preferably mounted to the front surface 26 of the mirror 20 after the frame is fully assembled as illustrated in FIG. 4. One method for mounting that can be followed, but which is not preferred, consists solely of removing the protective backing 50 from the fastening strips 38 of the assembled frame 28, and then immediately pushing the fastening strips against the mirror 20. Following this approach could disadvantageously result in the frame being mispositioned on the mirror. It is preferred for the frame 28 to be positioned properly the first time because it can, in some situations, be difficult to uninstall the frame, such as when the fastening strips 38 provide a substantially permanent attachment.

Figure 5:
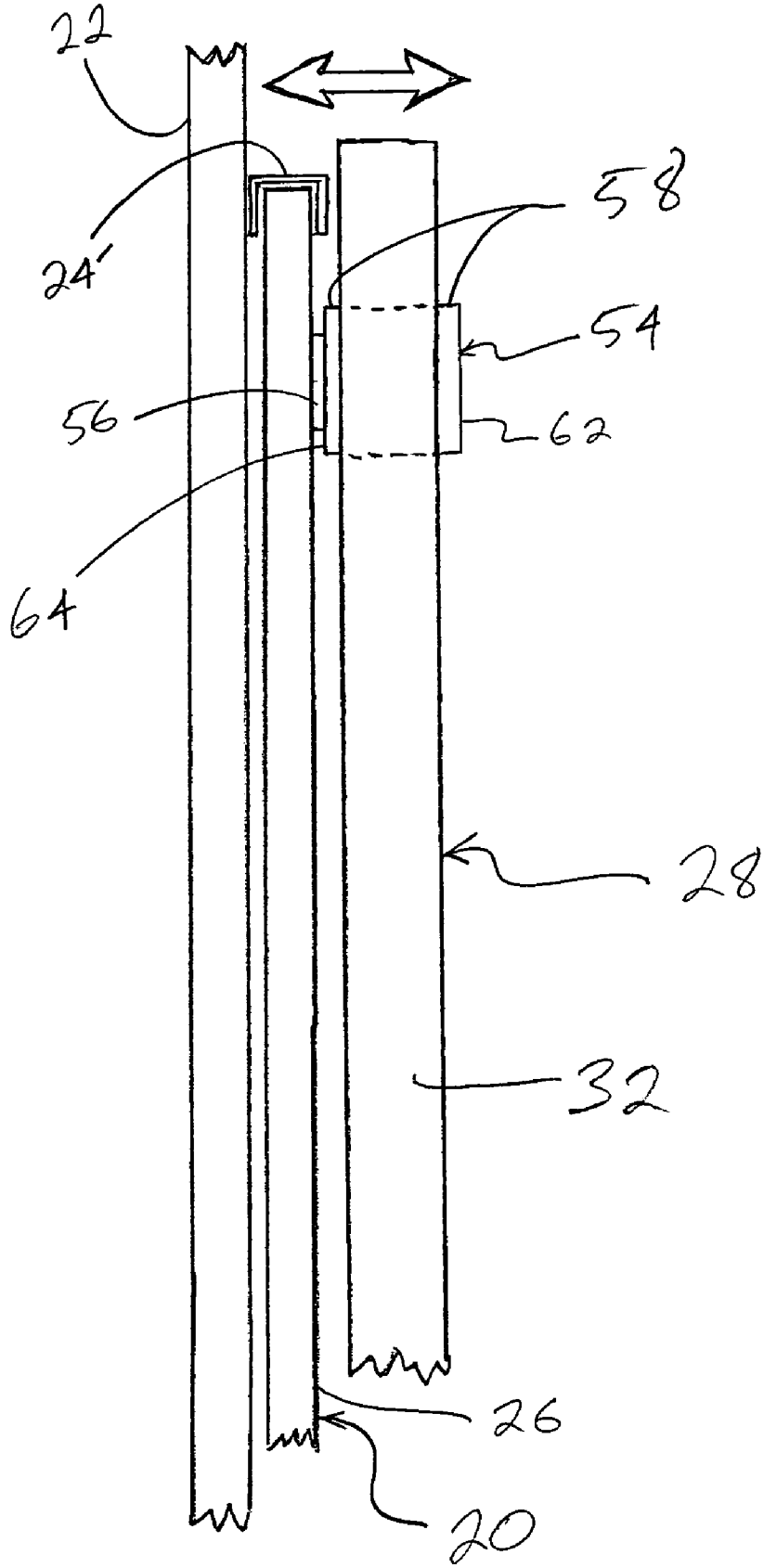
FIG. 5 is a schematic, side elevational, partial view which illustrates aspects of installing the frame to the mirror using guide structures, in accordance with the exemplary embodiment of the present invention.
Figure 6:
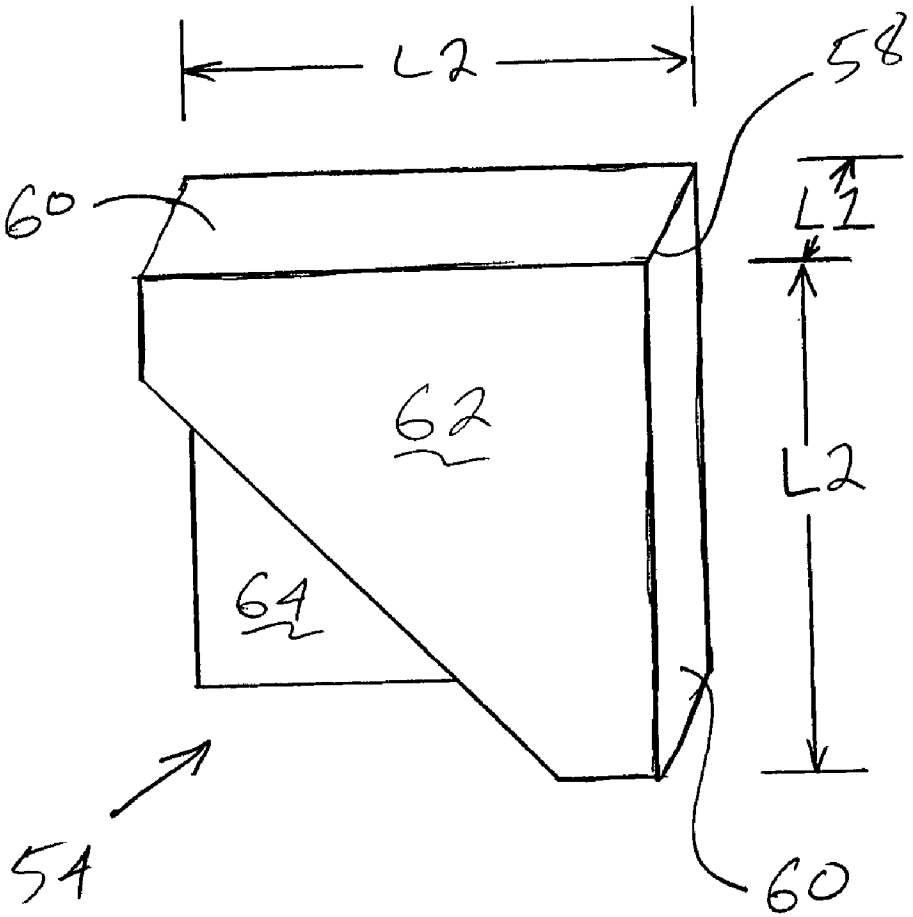
FIG. 6 is a schematic, isolated, front pictorial view of a representative guide structure, in accordance with the exemplary embodiment of the present invention.

In accordance with the exemplary embodiment of the present invention, guide structures 54, which are schematically illustrated by broken lines in FIG. 2, are used when mounting the frame 28 to the mirror 20. Use of the guide structures 54 advantageously seeks to ensure that the frame 28 will not be mispositioned when it is mounted. FIG. 5 schematically illustrates aspects of installing the frame 28 using the guide structures 54, and FIG. 6 is a schematic, isolated, front pictorial view of a representative guide structure 54. As can be best understood while also referring to the guide structures 54 illustrated in FIG. 2, FIG. 5 is a side view illustrating a representative guide structure 54 mounted to the mirror 20 and extending through the frame's opening 30. In FIG. 5, a middle portion of the guide structure 54 is hidden from view by one of the sidepieces 32. The hidden portion of the guide structure 54 is schematically illustrated by broken lines in FIG. 5.

A method of installing the fully assembled frame 28 using the guide structures 54 will now be described, in accordance with the exemplary embodiment of the present invention. Prior to mounting the frame 28 to the mirror 20, and preferably prior to removing any protective backing 50 from the frame's fastening strips 38, the frame is held up to the mirror in a predetermined position. The predetermined position can be characterized by the protruding portions of the fasteners 24 being respectively received by the recesses 46 and the frame 28 is otherwise being oriented in the manner in which it is desired for it to be permanently mounted to the mirror 20. For example, FIGS. 2 and 3 illustrate the frame positioned in an exemplary predetermined position. Any conventional aligning tool, such as a level (e.g., a tool which is for gauging horizontalness and includes a curved and marked tube containing fluid and a bubble), can optionally be used to as part of the process of determining the predetermined position.

While the frame 28 is in the predetermined position with the protective backing 50 of the frame's fastening strips 38 engaged to the front surface 26 of the mirror 20 (the protective backing 50 keeps the frame from becoming adhered to the mirror), the guide structures 54 are mounted at predetermined locations so that they can be used in the process of subsequently returning the frame to the predetermined position. As best understood with reference to FIG. 5, each guide structure 54 is preferably mounted in its predetermined location (e.g., to the front surface 26 of the mirror 20) by a fastening strip 56. The fastening strip 56 is preferably mounted to the guide structure 54 before the guide structure is mounted to the mirror 20.

As best understood with reference to FIGS. 2 and 5, the guide structures 54 are respectively mounted in their predetermined locations by inserting them through the frame's opening 30. Edges 58 or angles, or the like, of the guide structures 54 are respectively nested tightly with upper inside corners or angles of the frame 28 while the guide structures are mounted at their predetermined locations and the frame is in its predetermined position. Such nested angles are preferably of the same, or about the same, angular magnitude, such as about 90 degrees, so that they fit together well. While the guide structures 54 are so mounted, it is preferred for the edges 58 to extend at least substantially perpendicular to the mirror 20, and for the edges 58 to extend for a sufficient distance from the mirror so that the frame 28 can be suspended by and slid along the guide structures, as will be discussed in greater detail below. Referring to the representative guide structure 54 illustrated in FIG. 6, the edge 58 acceptably has a length L1 of about 3 inches, and each of the stabilizing surfaces 60 acceptably has a length L2 of about 3 inches.

The representative guide structure 54 illustrated in FIG. 6 includes front and rear walls 62, 64 that the edge 58 and stabilizing surfaces 60 extend between. As best understood with reference to FIG. 5, the rear surface of the rear wall 64 of the guide structure 54 is adhered to the front surface 26 of the mirror 20 by the fastening strip 56, which can be pressure-sensitive, double-sided tape (preferably a type that provides a releasable attachment), or the like. The fastening strips 56 can be replaced by other fastening devices which provide the desired function.

Figure 7:
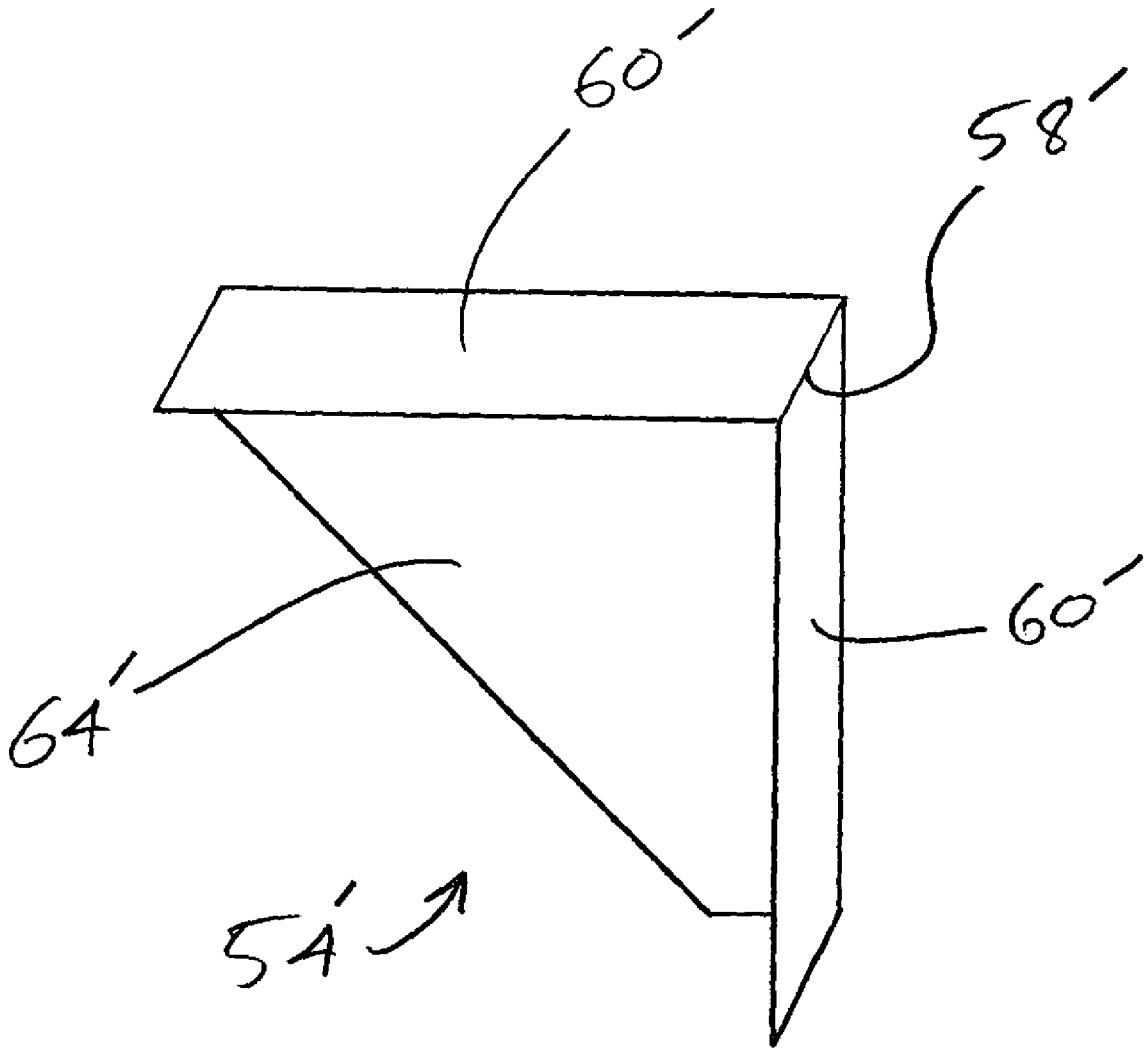
FIG. 7 is a schematic, front pictorial view of another representative guide structure, in accordance with another embodiment of the present invention.
Figure 8:
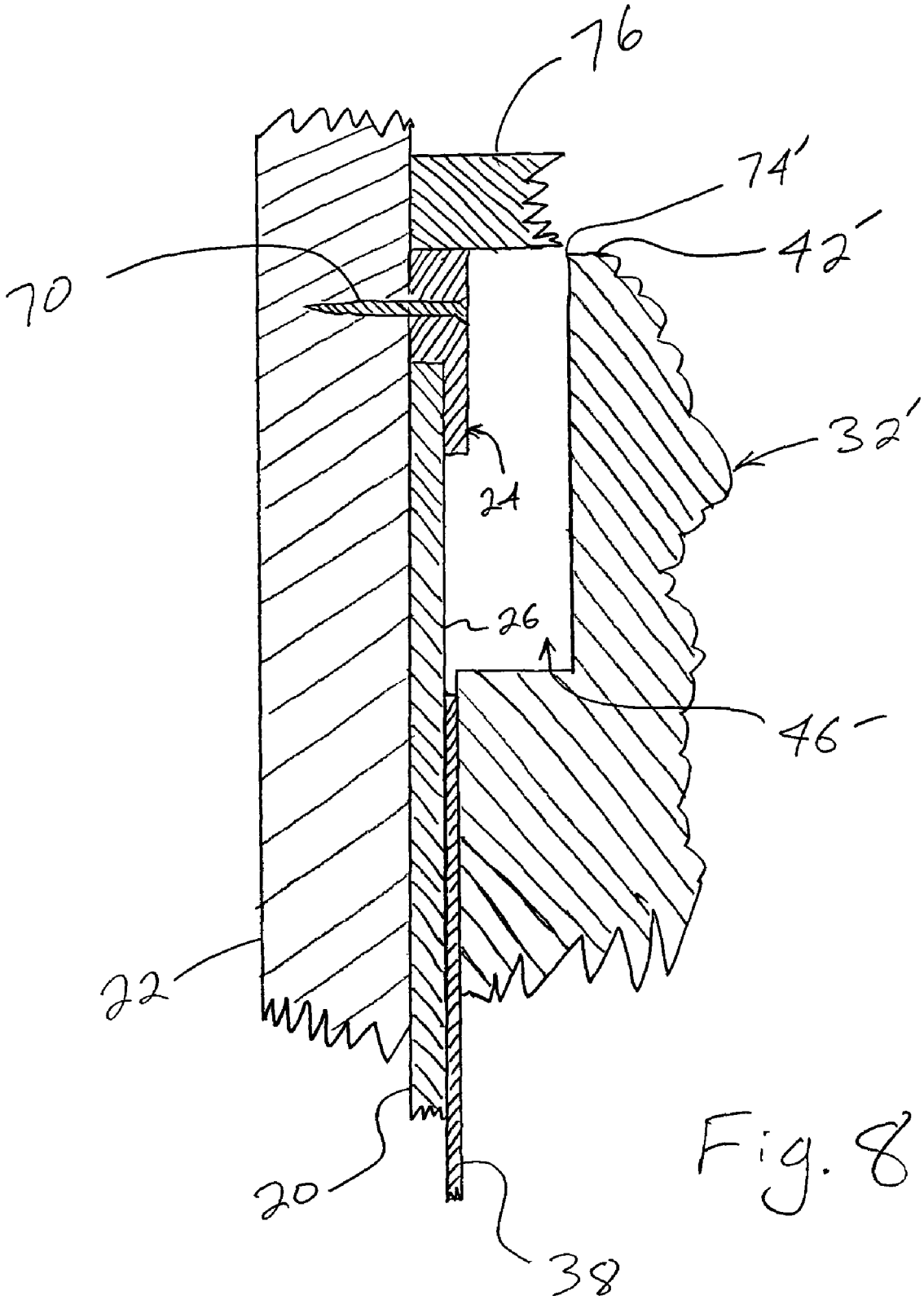

Acceptable guide structures 54, absent the fastening strips 56, are corrugated, cardboard corner guards. Corner guards have conventionally been used for covering and protecting corners of picture frames and tables. Suitable corner guards are available from Tharco of San Lorenzo, Calif. Alternatively, FIG. 7 is a schematic, front pictorial view of another representative guide structure 54' that is preferably formed from corrugated cardboard. In accordance with some embodiments of the present invention, the guide structures 54 and 54' can be formed from flat blanks. That is, flat blanks could respectively be folded to form the guide structures 54 and 54'. The guide structures 54 and 54' can be replaced with guide structures in the shape of cubes or other shapes suitable for providing the desired function, and the guide structures are not required to be constructed of corrugated cardboard, although they may be. Guide structures of any type which provide the desired function can be used.

As soon as the guide structures 54 are mounted to the front surface 26 of the mirror 20 in their predetermined locations as described above, the frame 28 is removed from the mirror and the guide structures. Then, the protective backing 50 is removed from the frame's fastening strips 38. Thereafter, the guide structures 54 are used to position and mount the frame 28 at the predetermined position. More specifically, the frame 28 is mounted by first using the guide structures 54, which are already mounted to the mirror 20 in their predetermined locations, to position the frame in front of the predetermined position, such that the frame 28 is suspended by the guide structures as illustrated in FIG. 5. Then, while the frame 28 is suspended by the guide structures 54, the frame is pushed rearward so that it slides along the guide structures and the fastening strips 38 eventually engage the mirror's front surface 26 and become adhered thereto. The frame 28 is pressed firmly against the mirror 20. This results in the frame 28 being mounted, in its predetermined position, to the mirror 20. The guide structures 54 and their associated fastening strips 56 are removed from the mirror 20 after the frame 28 is mounted.

As mentioned above, it is preferred for the frame's fastening strips 38 to be pressure-sensitive adhesive tape. It is preferred for these adhesive fastening strips 38 to have a set-up time/delay in permanent adhesion, such as a delay of about one to three seconds. As a result, if the user makes an error in mounting the frame 28, it can be quickly pulled away from the mirror 20, and then be mounted again, correctly, without having to replace the fastening strips 38.

Each of the frame's sidepieces 32 illustrated in FIGS. 3 and 4 can be characterized as including an elongate ridge 72 extending between its ends. These ridges 72 are at least partially defined by portions of the outermost periphery 42 of the frame 28 and the rear surface 36 of the frame. In this regard, the frame's outermost periphery 42 and the outermost margin of the frame's 28 rear surface 36 intersect at an outer circumferential edge 74 of the frame 28. The frame's outer circumferential edge 74 is distant from and outward of the recesses 46, and the frame's outer circumferential edge 74 and the rear surface 36 are substantially within a common plane. As a result, the ridges 72 advantageously help to hide the fasteners 24 from view.

In accordance with the exemplary embodiment of the present invention, the ridge 72 of any sidepiece 32 that is to cover fasteners 24 and is to abut an obstruction, such as a wall, ceiling, backsplash, or the like, is removed to enlarge the associated recess 46 and thereby accommodate the obstruction. For example, FIG. 8 is a partial, schematic, cross-sectional view which generally corresponds to the view of FIG. 3, except that the ridge 72 (see FIGS. 3 and 4 for example) of the illustrated sidepiece 32' has been removed to accommodate for an obstruction 76, such as a wall, ceiling, backsplash, or the like, in accordance with the exemplary embodiment of the present invention.

Figure 8:
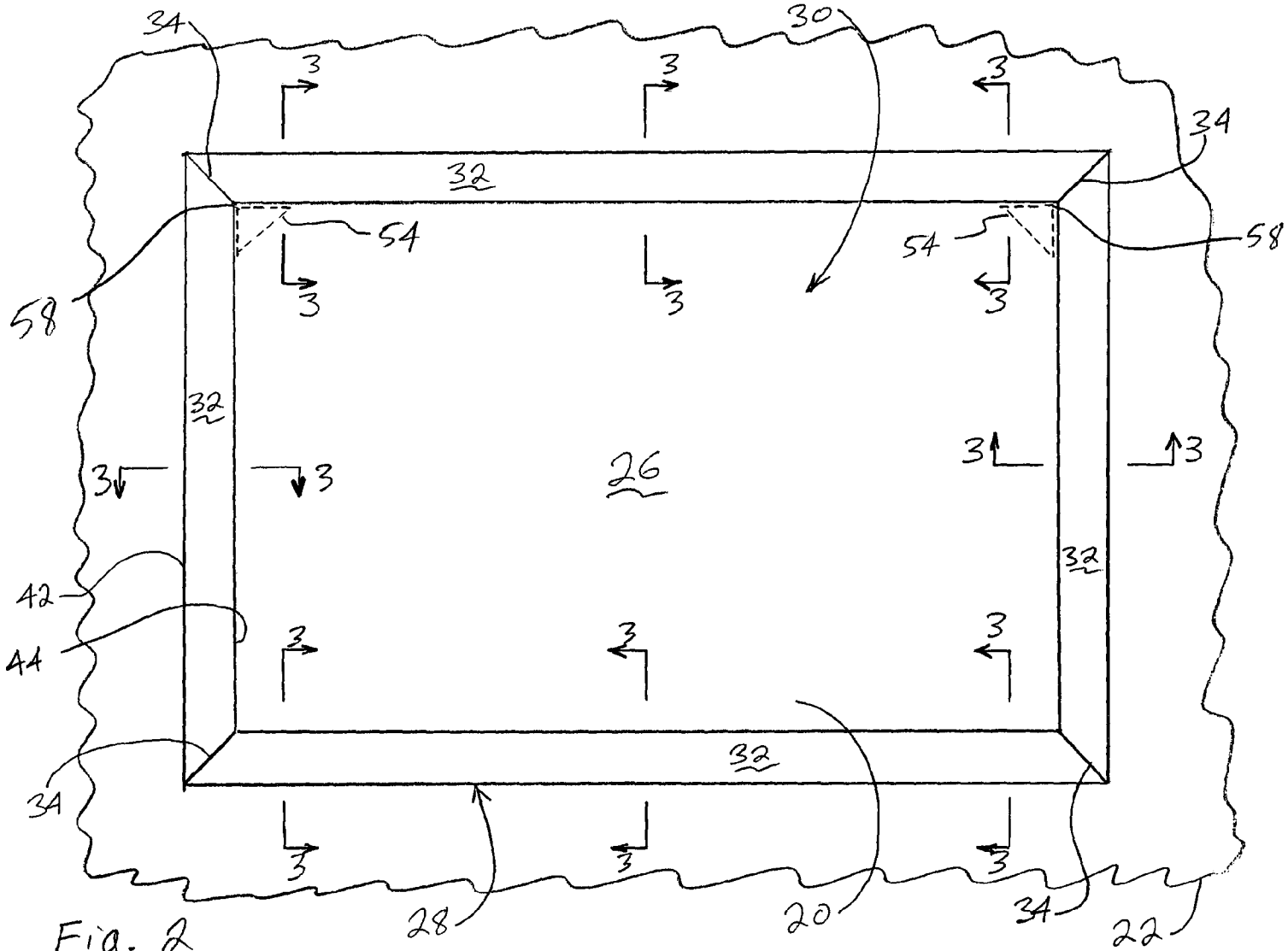
FIG. 8 is a partial, schematic, cross-sectional view which generally corresponds to the view of FIG. 3, except that a ridge of the illustrated sidepiece of the frame has been removed to accommodate for an obstruction, in accordance with the exemplary embodiment of the present invention.

As illustrated in FIG. 8, the frame's outermost periphery 42' and a surface which defines the enlarged recess 46' intersect at an outer circumferential edge 74' of the frame, and the outer circumferential edge 74' is contiguous with the enlarged recess. In accordance with the exemplary embodiment of the present invention, and based on information originally provided by the customer, the frame supplier can remove any ridges 72 prior to shipping the frame to the customer. In addition, the supplier preferably marks the sidepiece(s) without ridges 72 in an effort to aid the customer in installation.

For each of the sidepieces 32, it is preferred for the recess 46 and ridge 72 to be uniform along the length of the sidepiece, except for any variation resulting from miter cuts at the ends of the sidepiece. Likewise, for each of the modified sidepieces 32', it is preferred for the recess 46' to be uniform along the length of the modified sidepiece, except for any variation resulting from miter cuts at the ends of the modified sidepiece.

Various versions of the frame 28 of the exemplary embodiment include different combinations of sidepieces 32 with and without ridges 72. For example, a single frame 28 can have one sidepiece 32 without its ridge 72, with the remaining sidepieces of that same frame having their ridges. Likewise, a single frame 28 can have two sidepieces 32 without their ridges 72, with the remaining sidepieces of that same frame having their ridges. Similarly, a single frame 28 can have three sidepieces 32 without their ridges 72, with the remaining sidepieces of that same frame having their ridges, and so on. In addition, all of the sidepieces 32 of the same frame 28 can be similar by either all having, or not having, their ridges 72. This advantageously enables the frames 28 of the exemplary embodiment to be efficiently modularly used in a wide variety of different situations.

As best understood with reference to FIG. 3, and in accordance with one acceptable version, each frame sidepiece 32 has a width W1 of about 2 and ⅞ inches to about 4 inches, each ridge has a width W2 of about ¼ inch, and each recess has a width W3 of about 1 inch and a depth D of about ⅝ inch. In accordance with this version, preferably the fastening strip 38 begins at about ¼ inch from the frame's outermost periphery 44 so that it will not be seen in the mirror, and the fastening strip 38 extends almost to the recess 46. Accordingly, a substantial amount of the width of each sidepiece 32 is available for receiving its fastening strip 38, so that the fastening strip can have a substantial width and thereby securely mount the frame 28 to the mirror 20. In accordance with the exemplary embodiment of the present invention, and for each sidepiece, the fastening strip 38 (or the summation of multiple of the fastening strips 38 on the sidepiece) preferably has a width of at least about ¼ of the width of the sidepiece, more preferably the fastening strip has a width of at least about ⅓ of the width of the sidepiece, and most preferably the fastening strip has a width of at least about ½ of the width of the sidepiece.

Referring back to FIG. 3, the illustrated fastener 24 includes a bracket 66 with a body adjacent to the edge 40 of the mirror 20. The bracket 66 also includes a front leg 68 engaging the front surface 26 of the mirror 66. A nail, bolt, or perhaps more preferably a screw 70, extends through a hole in the bracket 66 and is securely anchored in the support structure 22. For example, in some home applications, the screw 70, or the like, will preferably extend through sheet rock of the support structure 22 and be securely embedded into underlying boards of the support structure. Alternatively, the bracket 66 may additionally include a rear leg that is positioned behind the mirror 20 and through which the screw 70, or the like, extends. For example see the fastener 24' of FIG. 5.

In situations in which the mirror 20 was originally installed with fasteners that are not positioned to be, or are too large to be, properly received by the recesses 46 or 46', suitable fasteners like the fasteners 24 or 24', or the like, are installed, and then the original fasteners are removed, prior to installing the frame 28. The suitable fasteners can be supplied by the supplier of the frame 28. An example of original fasteners that would need to be replaced include fasteners that resemble the fastener 24 illustrated in FIG. 3, but that are too large. Another example is fasteners that each include a screw passing through a hole in the mirror and a too large rosette-like washer positioned between the head of the screw and the mirror. More specifically, a fastener that is too large may protrude forward from the mirror 20 a distance greater than the depth D of the recess 46, and/or exceed the width W3 of the recess.

Figure 9:
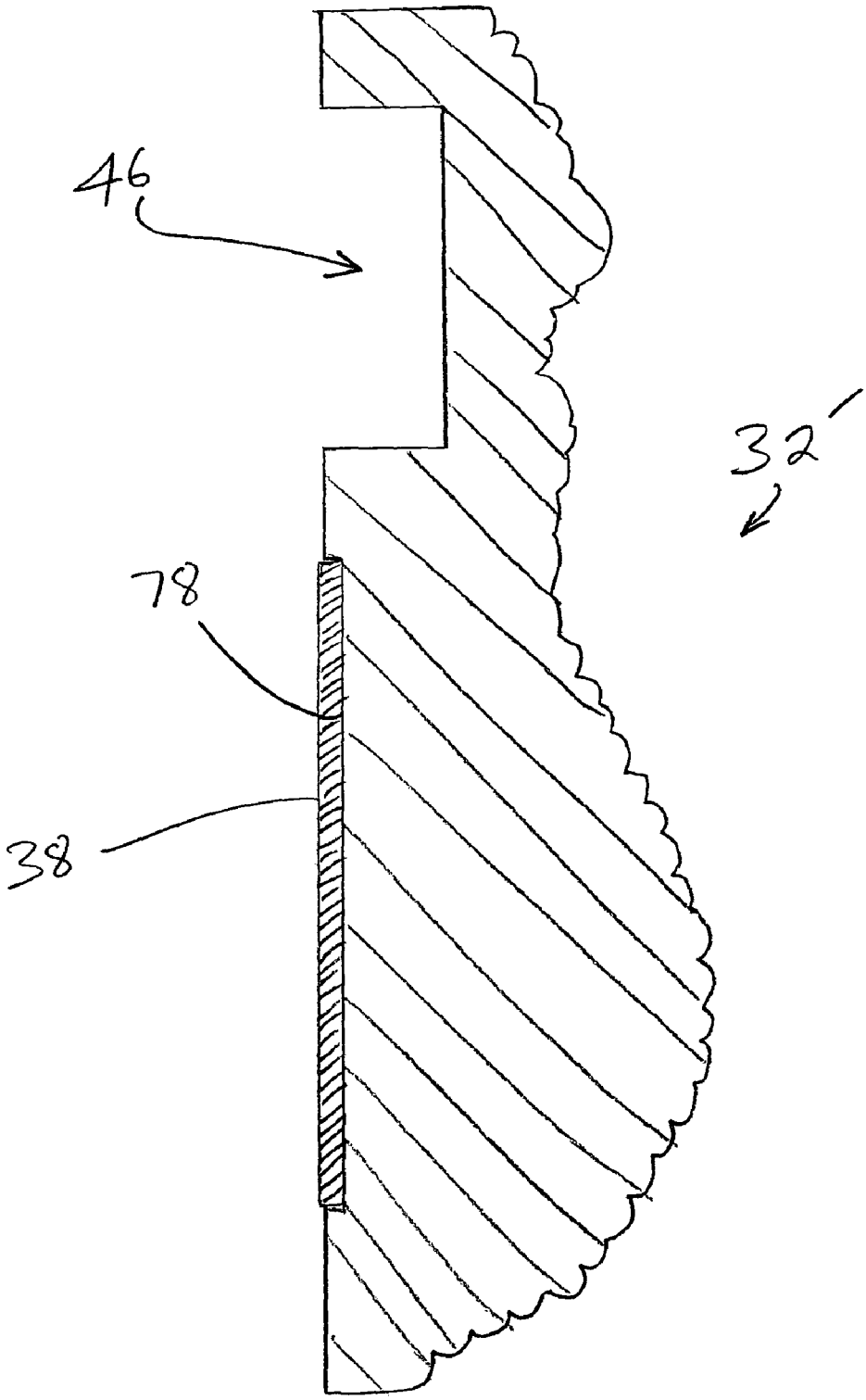
FIG. 9 is an isolated cross-sectional view of a sidepiece of a frame, with the cross-section taken perpendicular to the length of the sidepiece, in accordance with another embodiment of the present invention.

In accordance with the exemplary embodiment of the present invention, it is preferred for the frame's fastening strips 38 to be as thin as reasonably possible, so as to minimize any gap between the frame's rear surface 36 and the mirror's front surface 26, so that the rear surface of the frame is substantially flush with the front surface of the mirror. Alternatively, and referring to FIG. 9, any such gap can be minimized by partially positioning each of the fastening strips 38 in a respective recess 78. Each of the recesses 78 is slightly longer than and slightly wider than the fastening strip 38 that it receives.

Figure 10:
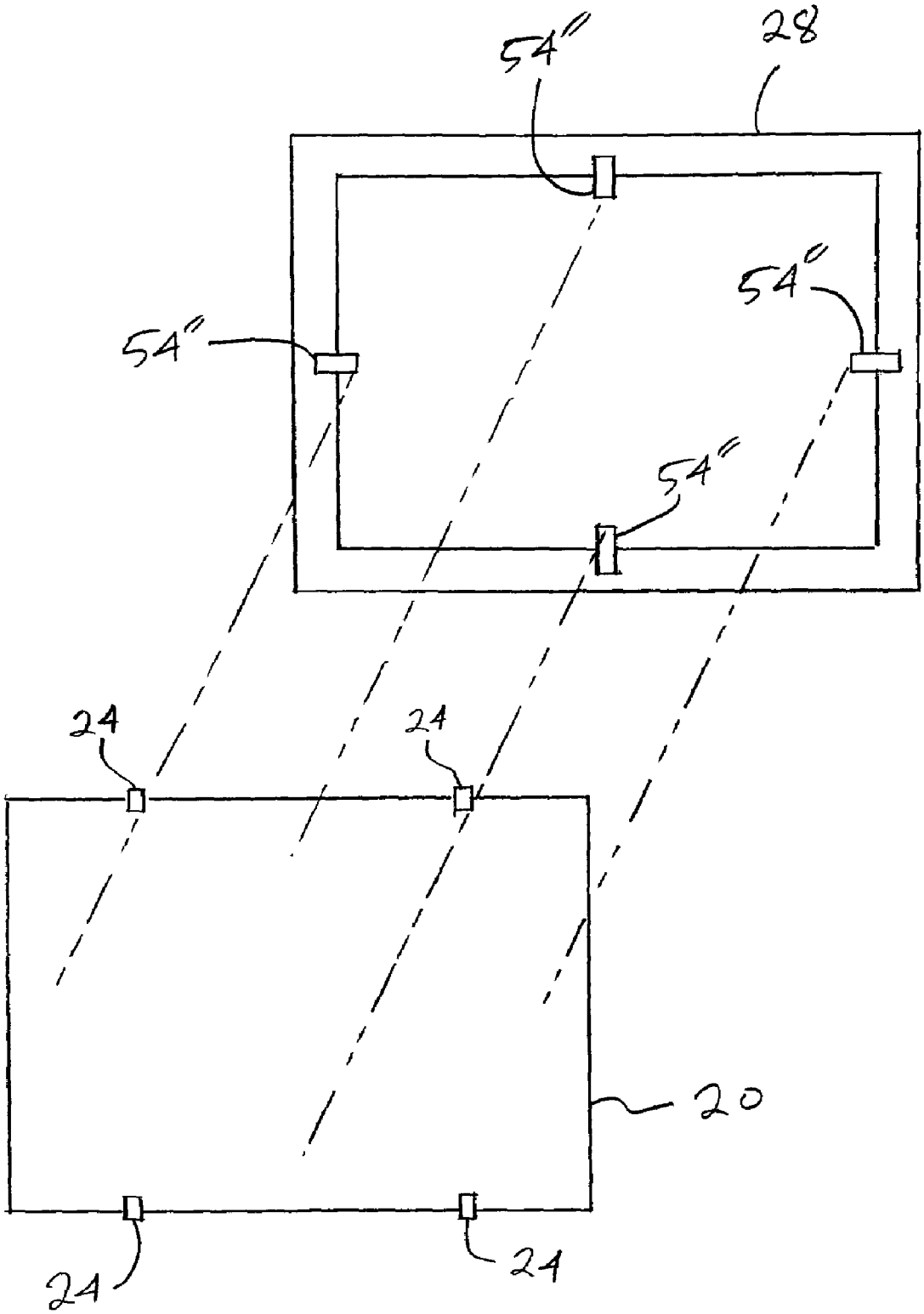
FIG. 10 schematically illustrates aspects of installing the frame to the mirror using alternative guide structures.
Figure 11:
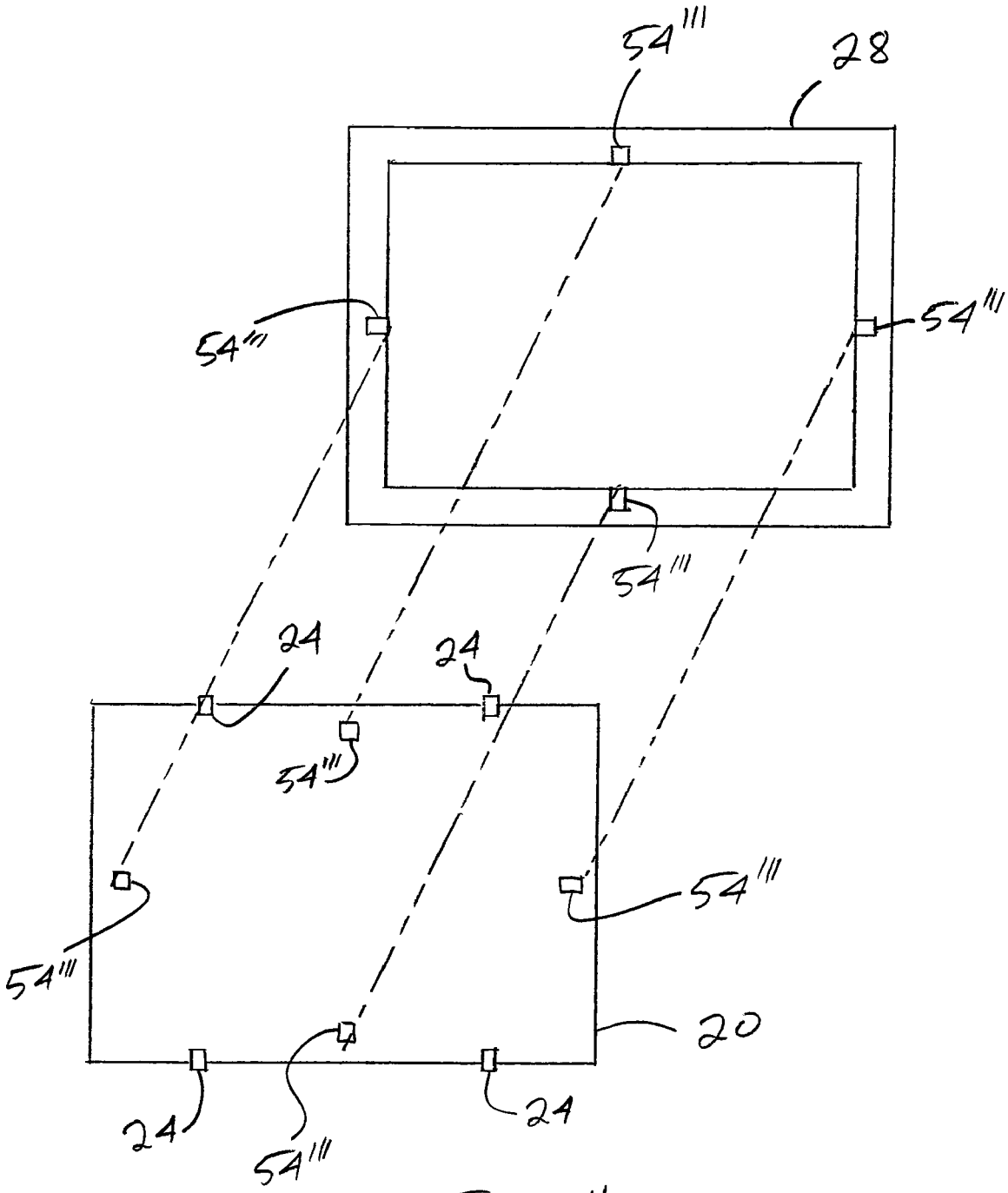
FIG. 11 is like FIG. 10, except that torn halves of the alternative guide structures are respectively attached to the frame and the mirror, in accordance with the alternative embodiment of the present invention.

FIGS. 10 and 11 schematically illustrates aspects of installing the frame 28 to the mirror 20 using alternative guide structures 54", in accordance with an alternative embodiment of the present invention. More specifically, FIG. 10 is schematic front view illustrating the frame 28 exploded away from the mirror 20, with the alternative guide structures 54" attached to the frame. FIG. 11 is schematic front view illustrating the frame 28 exploded away from the mirror 20, with portions of the alternative guide structures 54" respectively attached to the frame and the mirror. In accordance with the alternative embodiment of the present invention, each of the alternative guide structures 54" is a guide strip that is a piece of colored tape which is releasably adhesive on one side, and is perforated in the middle.

A method of installing a frame 28 will now be described, in accordance with the alternative embodiment of the present invention. First, and while the protective backing 50 remains on the frame's fastening strips 38, the frame 28 is moved to the predetermined position as schematically illustrated in FIG. 10 by the dashed lines. While the frame 28 is in the predetermined position with the protective backing 50 of the fastening strips 38 engaged to the front surface 26 of the mirror 20, and the guide strips 54" attached to the frame as illustrated in FIG. 10, the free ends of the guide strips 54" are adhered to the mirror's front surface. Then, the guide strips 54" are torn in half by removing the frame 28 from the mirror 20, to provide the configuration illustrated in FIG. 11. The tearing is at least partially facilitated by the perforations in the guide strips 54". As illustrated in FIG. 11, each of the guide strips 54" has been torn in half, so that there are half strips 54'" respectively on the frame 28 and mirror 20.

Thereafter, the protective backing 50 is removed from the frame's fastening strips 38, and the half strips 54'" are used to mount the frame 28 to the mirror 20. That is, the half strips 54'" are respectively aligned with one another in the manner schematically illustrated in FIG. 11 by the dashed lines, while mounting the frame 28 to the mirror 20 in the predetermined position. Then, all of the half strips 54'" are removed from the mirror 20 and the frame 28.

In some situations, the frame 28 does not interact with fasteners 24 or 24'. This may be the case, for example, when the rear surface of the mirror 20 is adhered to the wall 22 with epoxy, or when the mirror is secured to the wall by fasteners which are distant from the margin of the mirror. In situations such as these, the recesses 46, 46' can be omitted The wall 22 can be characterized as a supporting structure, and it is within the scope of the present invention for the wall to be replaced with any other type of supporting structure.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An apparatus, comprising:

a supporting structure;

a mirror including:

a rear surface that is in opposing face-to-face relation with the supporting structure, a front surface facing away from the supporting structure and for being viewed, and a margin;

one or more fasteners that fasten the margin to the supporting structure, with each of the fasteners including a protruding portion extending forward of the front surface of the mirror;

a frame extending around and thereby defining an opening, wherein:

a rear surface of the frame is mounted to the front surface of the mirror at the margin, so that at least some of the front surface is viewable through the opening and the frame at least partially covers the fasteners, and the frame defines one or more recesses which extend into the frame from the rear surface and that are respectively at least partially in receipt of the protruding portions of the fasteners, so that at least a substantial portion of the rear surface of the frame is substantially flush with the front surface of the mirror.

2. An apparatus according to claim 1, wherein the supporting structure is a wall of a building.

3. An apparatus according to claim 1, wherein each of the fasteners includes a bracket engaging an edge of the mirror.

4. An apparatus according to claim 1, wherein the frame has an outermost periphery and an innermost periphery, and an outermost edge of the mirror is closer to the outermost periphery than to the innermost periphery.

5. An apparatus according to claim 1, wherein the rear surface of the frame is adhered to the front surface of the mirror at the margin.

6. An apparatus according to claim 1, further comprising one or more fastening strips by which the rear surface of the frame is mounted to the front surface of the mirror at the margin, wherein the frame defines one or more recesses that respectively at least partially contain the fastening strips.

7. An apparatus according to claim 1, wherein the frame includes a front surface that is opposite from the rear surface and is decorative.

8. An apparatus according to claim 1, wherein the rear surface of the frame and an innermost periphery of the frame intersect at a circumferential edge of the frame, the circumferential edge at least partially defines the opening, and the circumferential edge and the rear surface of the frame are substantially within a common plane.

9. An apparatus according to claim 1, wherein at least an inner marginal portion of the rear surface of the frame is black.

10. An apparatus according to claim 1, wherein the rear surface of the frame includes an inner margin which extends around and is adjacent the opening, and the inner margin of the rear surface of the frame is positioned between the recesses and the opening.

11. An apparatus according to claim 10, wherein the rear surface of the frame further includes an outer margin, and the recesses are between the inner and outer margins of the rear surface.

12. An apparatus according to claim 1, wherein the frame includes a plurality of sidepieces that are respectively joined to one another end to end, at miter joints.

13. An apparatus according to claim 12, wherein the sidepieces respectively include the recesses.

14. A frame for mounting to a mirror that is fastened to a supporting structure by one or more fasteners which engage a margin of the mirror, wherein a front surface of the mirror faces away from the supporting structure and is for being viewed, and each of the fasteners includes a protruding portion extending forward of the front surface of the mirror, with the frame comprising:

a rear surface for being mounted to the front surface of the mirror at the margin, so that the frame borders at least some of the front surface and at least partially covers the fasteners while the rear surface of the frame is mounted to the front surface of the mirror at the margin;

an opening which the frame extends around, wherein at least some of the front surface of the mirror can be viewed through the opening of the frame while the rear surface of the frame is mounted to the front surface of the mirror at the margin;

one or more recesses which extend into the frame from the rear surface and that are for at least partially receiving the protruding portions of the fasteners while the rear surface of the frame is mounted to the front surface of the mirror at the margin, so that the rear surface of the frame can be substantially flush with the front surface of the mirror while the rear surface of the frame is mounted to the front surface of the mirror at the margin;

an innermost periphery which extends around and is contiguous with the opening, wherein the innermost periphery and the rear surface of the frame intersect at a circumferential edge that extends around and at least partially defines the opening, and the circumferential edge and the rear surface of the frame are substantially within a common plane; and an outermost periphery of the frame and a surface which defines a recess of the recesses intersect at an outer circumferential edge of the frame, the outer circumferential edge is contiguous with the recess, and the outer circumferential edge and the rear surface are not in a common plane.

15. A frame according to claim 14, wherein the circumferential edge is distant from and positioned substantially farther inward than the recesses.

16. An apparatus for framing a mirror that is fastened to a supporting structure by one or more fasteners which engage a margin of the mirror, wherein a front surface of the mirror faces away from the supporting structure and is for being viewed, and each of the fasteners includes a protruding portion extending forward of the front surface of the mirror, with the apparatus for framing comprising:

a plurality of sidepieces that are for being connected together to form a frame that:

has a rear surface for being mounted to the front surface of the mirror at the margin, so that the frame borders at least some of the front surface of the mirror and at least partially covers the fasteners while the rear surface is mounted to the front surface of the mirror at the margin;

defines an opening through which at least some of the front surface of the mirror can be viewed while the rear surface is mounted to the front surface of the mirror at the margin, defines one or more recesses which extend into the frame from the rear surface and that are for at least partially receiving the protruding portions of the fasteners, so that the rear surface of the frame can be substantially flush with the front surface of the mirror while the rear surface is mounted to the front surface of the mirror at the margin, wherein a first sidepiece of the plurality of sidepieces includes at least one of the recesses which extends between and to ends of the first sidepiece, and includes an innermost periphery wherein the innermost periphery and the rear surface of the frame intersect at an inner circumferential edge of the frame, the circumferential edge at least partially defines the opening, and the circumferential edge and the rear surface of the frame are substantially within a common plane.

17. An apparatus according to claim 16, wherein each of the sidepieces has a front surface that is decorative.

18. An apparatus according to claim 16, wherein for each of the sidepieces, the ends of the sidepiece are mitered.

19. An apparatus according to claim 16, wherein for each of the sidepieces, the side piece includes a rear surface having at least one fastening strip mounted thereto for mounting the rear surface of the frame to the front surface of the mirror at the margin.

* * * * *